US012258884B1

(12) United States Patent
Ari

(10) Patent No.: US 12,258,884 B1
(45) Date of Patent: Mar. 25, 2025

(54) POWER MACHINE

(71) Applicant: Bayram Ari, Istanbul (TR)

(72) Inventor: Bayram Ari, Istanbul (TR)

( * ) Notice: Subject to any disclaimer, the term of this patent is extended or adjusted under 35 U.S.C. 154(b) by 0 days.

(21) Appl. No.: 18/644,239

(22) Filed: Apr. 24, 2024

(51) Int. Cl.

| | |
|---|---|
| ***F01K 23/10*** | (2006.01) |
| ***F01K 13/02*** | (2006.01) |
| ***F01K 23/02*** | (2006.01) |
| ***F01K 25/00*** | (2006.01) |

(52) U.S. Cl.
CPC ..... *F01K 23/10* (2013.01); *F01K 13/02* (2013.01); *F01K 23/02* (2013.01); *F01K 25/00* (2013.01)

(58) Field of Classification Search
CPC ..... F01K 23/10; F01K 13/02; F01K 23/02; F01K 25/00
See application file for complete search history.

(56) References Cited

U.S. PATENT DOCUMENTS

| | | | | |
|---|---|---|---|---|
| 9,038,390 | B1 * | 5/2015 | Kreuger | F03G 6/005 60/670 |
| 11,852,044 | B2 | 12/2023 | Ari | |
| 2011/0131993 | A1 * | 6/2011 | Schule | F01K 3/265 60/645 |
| 2016/0190896 | A1 * | 6/2016 | Stiller | F25J 1/0045 290/52 |
| 2016/0370111 | A1 * | 12/2016 | Alekseev | F25J 3/0406 |

OTHER PUBLICATIONS

Ahmet Rasim Büyüktür,Thermodynamics, Basic Laws of Thermodynamics 1995, pp. 189-192, vol. 1.

* cited by examiner

*Primary Examiner* — Hoang M Nguyen
(74) *Attorney, Agent, or Firm* — Bayramoglu Law Offices LLC

(57) ABSTRACT

A power machine is disclosed. The power machine can be both stationary and mobile, uses a liquid air mixture as a fluid, obtains its energy from the sun and utilises atmospheric air. The power machine includes a liquid air storage tank (1), a pump (2), a first heat exchanger (3), a heater (4), a turbine (5), a radial compressor (6), a second heat exchanger (7), a first Joule-Thompson valve (8) and a second Joule-Thompson valve (9).

14 Claims, 4 Drawing Sheets

POWER MACHINE

TECHNICAL FIELD

The present application relates to a power machine in the thermodynamic field, such as a steam power plant and liquid air production, both stationary and mobile, which uses a liquid air mixture as a fluid, obtains its energy from the sun and utilizes atmospheric air.

BACKGROUND

Technically, water and water vapour are used in steam power plants. Steam power plants also have boilers. Various fuels such as liquified petroleum gas (LPG), diesel, fuel oil, natural gas and nuclear fuel etc. are used in these boilers. Some of these plants operate according to the supercritical Rankine cycle. In these closed system steam power plants, liquid and steam are heated and cooled at constant pressure.

In pumps the fluid is isoentropically compressed, in turbines and compressors it is isoentropically expanded and compressed. The fluid expands isoentropically.

Differences in kinetic and potential energy are neglected and heat transfer in the heat exchanger takes place at constant pressure. Continuous process conditions apply and heat loss in the heat exchanger is negligibly isolated in the tanks, pipes, Joule Thomson valve and turbine. The properties of the fluid are kept constant, the heat conduction in the axial length is greatly reduced and the continuity equation is always provided.

In order to obtain the actual cycle of steam engines, the friction losses and heat losses at various points and the difference required for heat transfer in the heaters should be taken into account.

U.S. Pat. No. 11,852,044B2 discloses a steam power plant-like power machine system that can be used both stationary and mobile, and using a mixture of liquid nitrogen and/or liquid air as a fluid and atmospheric air as an energy source, is mentioned.

When the existing studies in the art are examined, the existing steam engines cause air pollution due to the fossil fuels and nuclear energy they use.

SUMMARY

An object of preferred embodiments is to realise a power machine without any pollution, where the waste is completely atmospheric air.

Another object of preferred embodiments is to realise a power machine that reduces the greenhouse effect, reduces global warming and helps prevent the melting of glaciers, as well as cooling the earth, and continuously receive energy from the atmosphere.

Another object of preferred embodiments is to realise an environmentally friendly power machine using air instead of fossil fuels.

Another object of preferred embodiments is to realise a power machine that can be used in a space station and on spacecraft.

Another object of preferred embodiments is to realise a power machine for the production of liquid air.

Another object of preferred embodiments is to realise a power machine that can be used in the agricultural sector, in the production of nitrogen fertiliser, in the health sector and in the welding sector in industry with the production of liquid air.

Another object of preferred embodiments is to realise a power machine that can be integrated into a water electrolysis system to obtain the energy required for the production of hydrogen and oxygen by the water electrolysis system and, at the same time, to liquefy the hydrogen and oxygen produced.

Various embodiments disclosed herein and illustrated in the figures achieve one or more of these objects.

In accordance with one exemplary embodiment, a power machine utilises a liquid air mixture as a fluid, obtains its energy from the sun and utilises atmospheric air. The power machine includes a storage tank, a pump, a first heat exchanger, a heater, a turbine, a second heat exchanger, a radial compressor, a first Joule-Thompson valve and a second Joule-Thompson valve. The storage tank contains liquid air, and the pump is connected to the storage tank and configured to increase a pressure of the liquid air taken from the storage tank. The first heat exchanger is connected to the pump and is configured to heat the liquid air with atmospheric air after the liquid air leaves the pump. The heater is connected to the first heat exchanger and is configured to heat the liquid air to atmospheric air temperature after the liquid air leaves the first heat exchanger. In addition, the turbine is connected to the heater. Further, the second heat exchanger is configured to cool steam from a turbine outlet of the turbine and a radial compressor with air from the storage tank. The radial compressor is connected to the first heat exchanger and is configured to vacuum vapour from the second heat exchanger to increase a vapour pressure. Further, the first Joule-Thompson valve is connected to the second heat exchanger and is configured to reduce an exhaust air pressure of the turbine exiting from second heat exchanger. Additionally, the second Joule-Thompson valve is configured to depressurize ambient air after the ambient air leaves the first heat exchanger.

In accordance with one exemplary aspect, the power machine comprises a first adjustable valve at an inlet of the pump, a second adjustable valve at an outlet of the pump, a third adjustable valve at an inlet of a first starting tube and fourth adjustable valve at an inlet of the turbine for controlling fluid flow.

In another exemplary aspect, the power machine further comprises a first starting tube connected to the heater and to the turbine.

In another exemplary aspect, the power machine further comprises an alternator connected to the turbine, wherein the alternator is configured to generate an alternating current from work generated by the turbine.

Another exemplary embodiment is directed to a method for operating the power machine. In accordance with the method, the liquid air in the storage tank is pressurized by the pump and the pressurized liquid air is transferred to the first heat exchanger. Further, the pressurized liquid air is heated by the first heat exchanger with the atmospheric air. In addition, the heated pressurized liquid air is transferred to the heater and heated by the heater to the atmospheric air temperature. The liquid air heated by the heater is conveyed to the turbine to generate work by the turbine.

In accordance with one aspect of the method, the heating the pressurized liquid air comprises pressing ambient air into the first heat exchanger by the radial compressor to heat the pressurized liquid air.

According to another exemplary aspect of the method, the heating by the heater comprises utilizing a fan in the heater. In accordance with one exemplary feature, the blowing speed of the fan is at least 1.5 m/s to prevent freezing.

According to another exemplary aspect of the method, the liquid air is transferred from the turbine to the second heat exchanger to cool the liquid air in the second heat exchanger. According to another exemplary feature, the method includes transferring the liquid air from the second heat exchanger to the first Joule-Thomson valve, and expanding the liquid air in the first Joule-Thomson valve with constant enthalpy.

In another exemplary aspect of the method, steam is transferred from the storage tank to the second heat exchanger to cool the steam from the storage tank. Further, one exemplary feature of the method includes transferring the cooled steam to the first heat exchanger via the radial compressor to reduce a pressure of the cooled steam and to further cool the cooled steam in the first heat exchanger. In accordance with an additional aspect of the method, the further cooled steam is transferred to the second Joule-Thomson valve such that the further cooled steam is expanded with constant enthalpy. Further, in another exemplary feature, the expanded cooled steam is transferred to the storage tank.

BRIEF DESCRIPTION OF THE DRAWINGS

In order to more clearly illustrate the embodiments of the present disclosure, a brief description of the drawings is given below. The following drawings are only illustrative of some of the embodiments of the present disclosure and for a person of ordinary skill in the art, other drawings or embodiments may be obtained from these drawings without inventive effort.

DETAILED DESCRIPTION

Components illustrated in the figures are individually numbered and the equivalents of said numbers are provided below.

Figure 1:
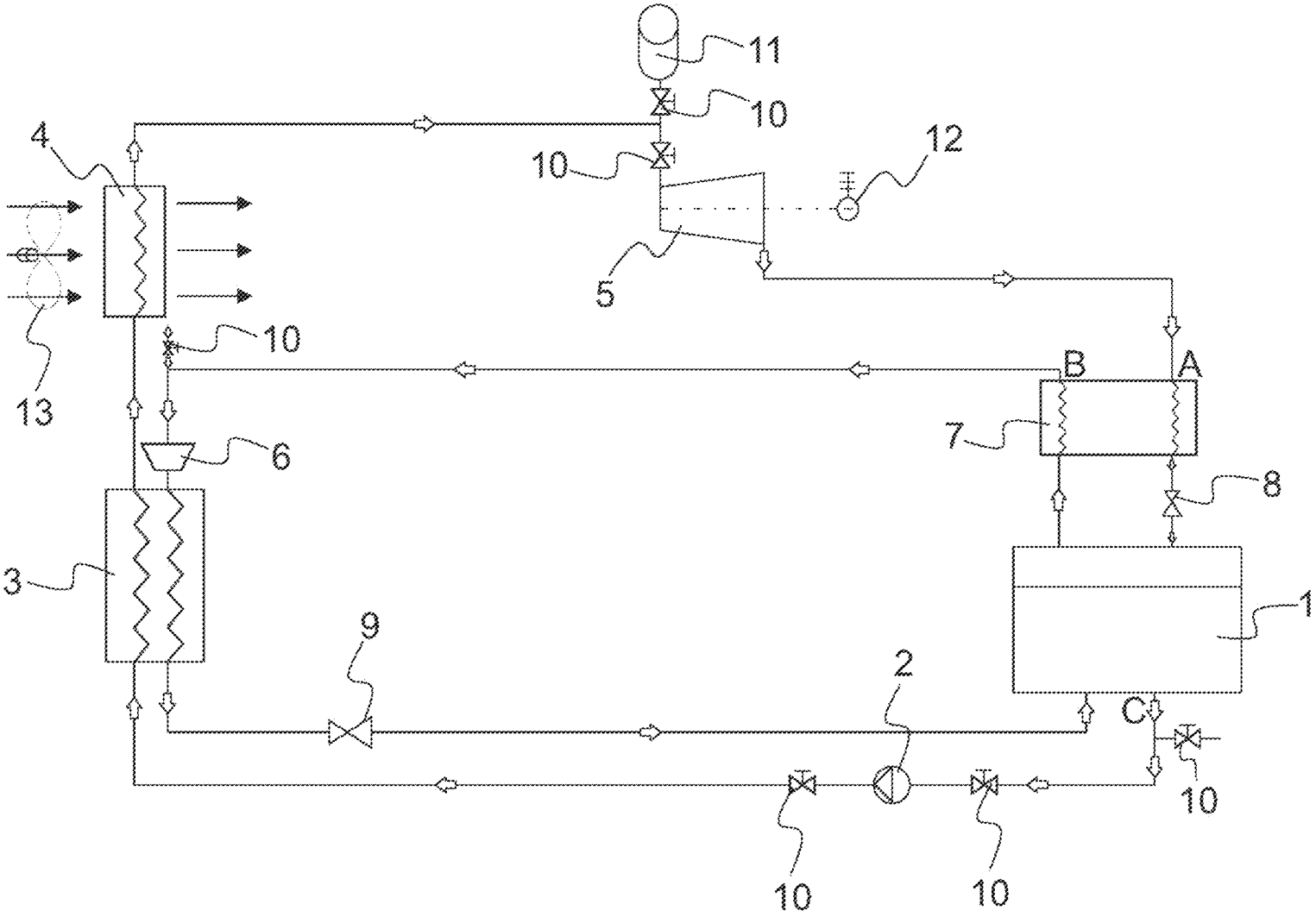
FIG. 1 is a schematic diagram of a preferred embodiment of a power machine.
Figure 2:
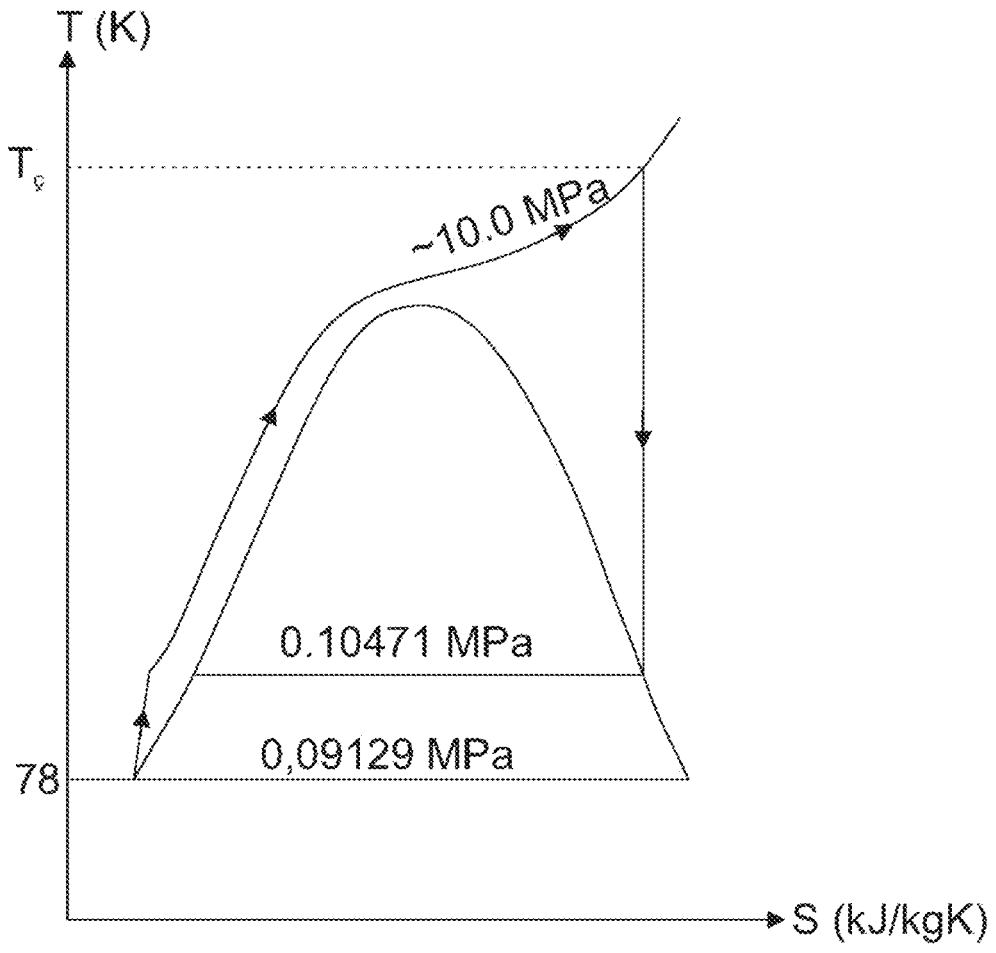
FIG. 2 depicts a Temperature-Specific heat (T-S) diagram.

1. Storage Tank
2. Pump
3. Heat Exchanger I
4. Heater
5. Turbine
6. Radial Compressor
7. Heat Exchanger II
8. Joule-Thompson Valve I
9. Joule-Thompson Valve II
10. Adjustable Valve
11. First Starting Tube
12. Alternator
13. Fan
A, Turbine (5) outlet and heat exchanger II (7) inlet line
B, Heat exchanger II (7) outlet and radial compressor (6) inlet line
C, Storage tank (1) outlet and pump (2) inlet line Preferred embodiments are directed to a stationary and mobile power machine, schematically illustrated as FIG. 1, which utilises a liquid air mixture as a fluid, which obtains its energy from the sun and which utilises atmospheric air, and comprises:

Storage tank (1) containing liquid air,
Pump (2) connected to the storage tank (1) and allowing to increase the pressure of the liquid air taken from the storage tank (1),
Heat exchanger I (3) connected to the pump (2), which heats the liquid air leaving the pump (2) with atmospheric air,
Heater (4) connected to the heat exchanger I (3), which heats the liquid leaving the heat exchanger I (3) to atmospheric air temperature,
Turbine (5) in connection with heater (4),
Heat exchanger II (7), which cools the steam coming from the turbine (5) outlet and radial compressor (6) with the cold air coming from the storage tank (1),
Radial compressor (6) in connection with heat exchanger I (3) and vacuuming the vapour from heat exchanger II (7) to increase the vapour pressure,
Joule-Thompson valve I (8) in connection with heat exchanger II (7) and for reducing the exhaust air pressure of the turbine (5) exiting from heat exchanger II (7),
Joule-Thompson valve II (9) for depressurising the ambient air leaving heat exchanger I (3),
First starting tube (11) in connection with heater (4) and turbine (5),
Alternator (12) connected to the turbine (5) and generating alternating current with the work received from the turbine (5).

The power machine according to preferred embodiments is provided with adjustable valves (10) at the inlet and outlet of the pump (2), at the inlet of the first starting tube (11) and at the inlet of the turbine (5) for controlling the fluid flow. The power machine has an internally tangent and closed two-cycle structure. In the first cycle, firstly, the liquid air fluid in the storage tank (1) is pressurised by means of the pump (2) and sent to the heat exchanger I (3). The cold liquid air coming from the pump (2) is heated in the heat exchanger I (3) with the help of atmospheric air. The radial compressor (6) presses the ambient air into the system in the amount of the amount of liquid withdrawn from the system and the air will be heated as a result of compression. If no liquid air is drawn, the vapour drawn from the tank (1) is compressed to a pressure of 0.101325 MPa. Therefore, the radial compressor (6) always provides 0.101325 MPa pressure to the system.

The liquid air heated by the heat exchanger I (3) is then transferred to the heater (4). The liquid air is heated again in the heater (4) to atmospheric air temperature with the help of the fan (13). The blowing speed of the fan (13) should be at least 1.5 m/s to prevent freezing. The liquid air heated by the heater (4) (in its supercritical state) is then conveyed to the turbine (5). Here, the hot air coming out of the heater (4) is also filled into the first starting tube (11). In the power machine, the first starting tube (11) and the turbine (5) can be used to generate work if required.

The cold air from turbine (5) is transmitted to heat exchanger II (7). The temperature of the exhaust gas leaving the turbine (5) is 82 K and the pressure is 0.10471 MPa. The degree of dryness of the turbine (5) outlet is x=0.87. This value is both suitable for efficiency and a value that will not damage the turbine (5) rotor blades. If the degree of dryness is higher, the rotor blades may be damaged by air droplets.

The heat exchanger II (7) is connected to the Joule-Thomson valve I (8) and contains cold steam from the storage tank (1).

The air cooled by heat exchanger II (7) is conveyed to Joule-Thomson valve I (8). Here it expands with constant enthalpy. The enthalpy value at the outlet of turbine (5) can be calculated with the help of Formula I.

$$h=h_{liquid}+x(h_{steam}-h_{liquid}) \quad \text{(Formula I)}$$

x is the degree of dryness.

With the Joule-Thompson valve I (8), the temperature of the fluid is reduced to 78 K, the final pressure $P_{final}$=0,09129 MPa and the vapour pressure $P_{steam}$=0,06381 MPa. In this case, the liquefaction line of the air is in vacuum and the storage tank (1) is at negative pressure.

In the second cycle, the steam taken from the storage tank (1) is transferred to heat exchanger II (7). The steam cooled here is sucked by radial compressor (6) and transferred to heat exchanger I (3). Here, the pressure of the liquid is reduced to 0.06381 MPa. In heat exchanger I (3), the liquid is cooled again and transferred to Joule-Thomson valve II (9). Here it expands with constant enthalpy and is transferred back to the storage tank (1).

In the power machine, a depressurised liquid is conveyed from the heat exchanger II (7) to the storage tank (1), where a portion of the liquid evaporates. The steam here is sucked by the radial compressor (6) and transmitted to the heat exchanger I (3).

In alternative embodiments of the power machine, vehicles such as submarines and torpedoes are stationary or moving in the sea. In this case, the fan (13) will not work. Instead of the fan (13), a pump (2) can be used to mobilise sea water.

Pressure Throttling in Joule-Thomson Valves (8), (9);

If it is desired to reduce the temperature of the air as much as possible as a result of throttling, it is necessary to start the throttling process from a point on the inversion curve.

Figure 3:
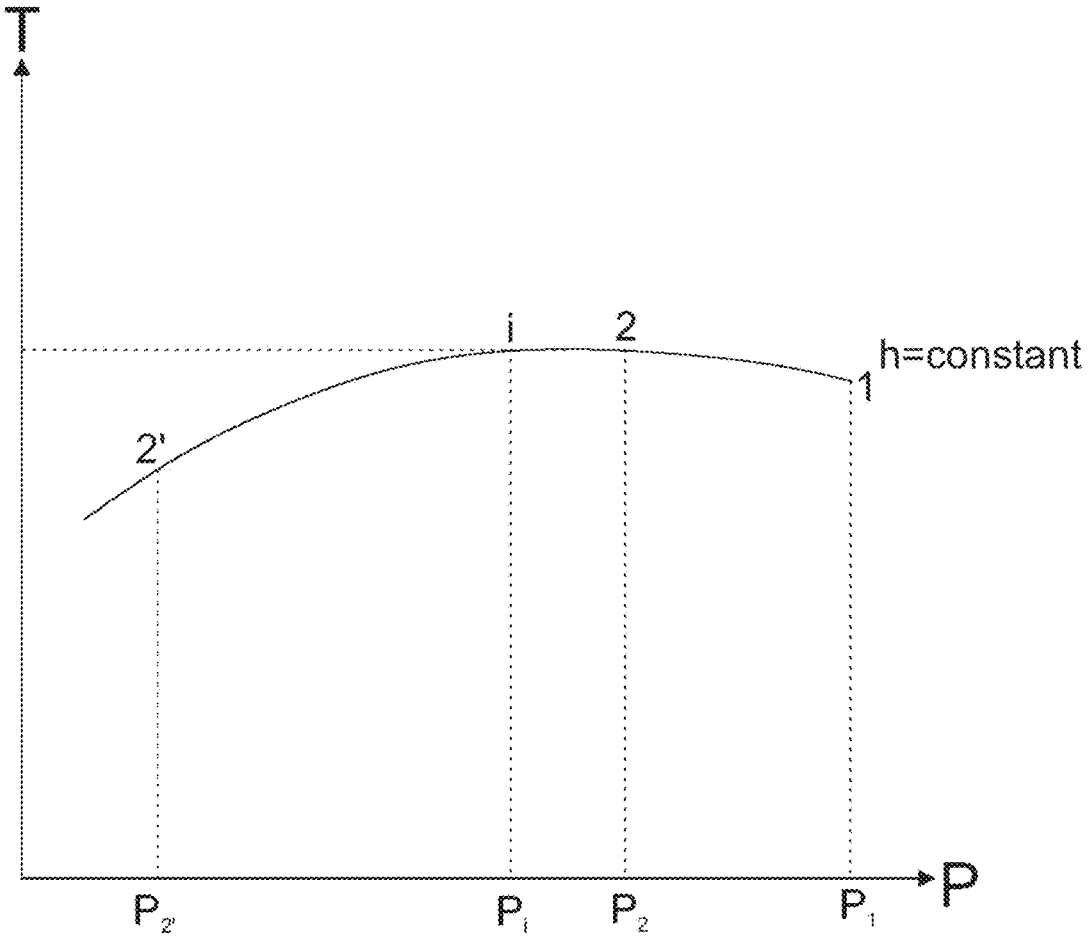
FIG. 3 depicts a constant enthalpy curve in a Temperature-Pressure (T-P) diagram.
Figure 4:
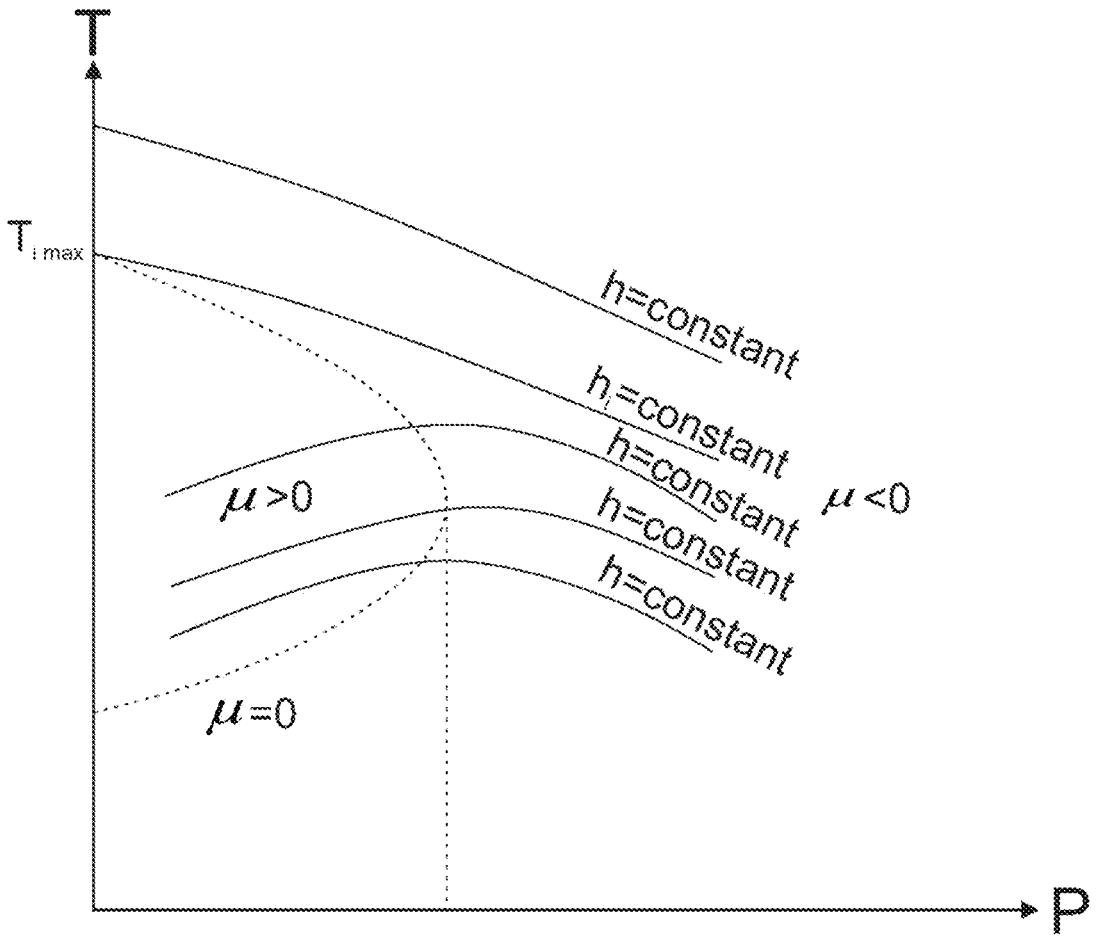
FIG. 4 depicts an inversion curve in a Temperature-Pressure (T-P) diagram.

If the constant enthalpy curves are shown on the T-P diagram, it is seen that they pass through a maximum, as illustrated in FIG. 3-4. The maximum point where the Joule-Thompson coefficient is equal to zero and changes sign is called the "inversion" point (i). As can be easily seen from FIG. 3, the sign of the Joule-Thompson coefficient depends on the value of the pressure P1 at the beginning of the throttling. If P1<$P_i$, the temperature of the gas always decreases as a result of throttling. If P1>$P_i$, the gas heats up until the pressure drops to $P_i$. If the throttling process is continued, the gas starts to cool down. In this last case, the integral Joule-Thompson effect (P1-P2) depends on the total pressure difference.

If the point 1, which determines the start of throttling, is changed, a series of constant enthalpy curves are obtained in the T-P diagram, as illustrated in FIG. 4. Those corresponding to h>$h_i$ pass through a maximum. The $T_{imax}$ temperature measured at this point is the maximum inversion temperature.

The curve joining the maxima of the constant enthalpy curves is called the inversion curve. On this curve μj=0, outside μj<0 and inside μj>0.

The power machine in accordance with exemplary embodiments operates in the region where μj>0.

The information described above is of great importance in practice. If it is desired to reduce the temperature of the gas as much as possible as a result of throttling, the throttling process must start from a point on the inversion curve. If unnecessarily high pressures are used for the start, the temperature of the gas will first increase and then decrease during the throttling process. As a result, the integral Joule-Thompson effect may be equal to zero.

For most of the gases, the maximum inversion temperature is above the ambient temperature. For Helium and Hydrogen, it is lower than the ambient temperature. For this reason, if these gases, which are handled at ambient temperature, are throttled starting from high pressures, the heating will be quite high. For example, if a leak occurs in a system containing hydrogen at high pressure, the temperature reached by hydrogen as a result of throttling may cause explosions. At very low temperatures, hydrogen and helium behave like other gases. For example, it is possible to throttle hydrogen after cooling with liquid air and thus liquefy it.[1]

Establishment of the Control Volume in the Power Machine;

If the amount of liquid or vapour circulating in the system is examined, assume that there is 1 kg of fluid in the system.

In this case, y kg of air passes through the heater (4), turbine (5) and point A. (1−y) kg of fluid passes through heat exchanger II (7), radial compressor (6) heat exchanger I (3) and Joule-Thomson valves (8), (9).

When the control volume is created to include heat exchanger II (7), Joule-Thomson valves (8), (9) and tank (1), the energy entering the system is the energy leaving the system according to the law of conservation of energy.

$$yh_A+(1-y)h_g=yh_C+(1-y)h_B \quad \text{(Formula II)}$$

The amount of liquid condensed after processing is obtained with the help of formula III.

$$y=\frac{(hB-hg)}{(hB-hC)+(hA-hg)} \quad \text{(Formula III)}$$

$h_A$, Enthalpy value at point A $h_B$, Enthalpy value at point B $h_C$, Enthalpy value at point C hg, Enthalpy value in front of Joule-Thomson valve I (8)

One of the alternative application areas of preferred power machine embodiments is their use in submarines, torpedoes, and the like. In this case, a counter-flow heat exchanger should be used without a fan instead of the heater (4). The temperature at the centre of the earth is approximately 6000° C. Heat from the centre of the earth is transferred to the earth's surface by cooling from various layers. For this reason, heat sources are formed at certain depths of the earth, both on land and in the sea. The sun also heats both the land and the sea to a certain depth. Preferred power machine embodiments can be implemented based on these heat sources as well.

The above-mentioned embodiments of the present disclosure are only examples for describing the present disclosure more clearly, rather than limiting an implementation mode of the present disclosure. For those of ordinary skill in the art, other variations or changes in different forms can be made on the basis of the above description. The obvious variations or changes derived from the technical solutions of the present disclosure still fall within the scope of protection of the present disclosure.

What is claimed is:

1. A power machine, which utilises a liquid air mixture as a fluid, which obtains energy from the sun and which utilises atmospheric air, comprising:

a storage tank containing liquid air;

a pump connected to the storage tank and configured to increase a pressure of the liquid air, which is taken from the storage tank;

a first heat exchanger connected to the pump, wherein the first heat exchanger heats the liquid air with atmospheric air after the liquid air leaves the pump;

a heater connected to the first heat exchanger, wherein the heater is configured to heat the liquid air to atmospheric air temperature after the liquid air leaves the first heat exchanger;

a turbine connected to the heater;

a second heat exchanger, wherein the second heat exchanger is configured to cool steam from a turbine outlet of the turbine and a radial compressor with air from the storage tank;

the radial compressor, wherein the radial compressor is connected to the first heat exchanger and wherein the radial compressor is configured to vacuum vapour from the second heat exchanger to increase a vapour pressure;

a first Joule-Thompson valve connected to the second heat exchanger, wherein the first Joule-Thompson valve is configured to reduce an exhaust air pressure of the turbine exiting from second heat exchanger;

a second Joule-Thompson valve configured to depressurize ambient air after the ambient air leaves the first heat exchanger.

2. The power machine according to claim 1, further comprising a first adjustable valve at an inlet of the pump, a second adjustable valve at an outlet of the pump, a third adjustable valve at an inlet of a first starting tube and fourth adjustable valve at an inlet of the turbine for controlling fluid flow.

3. The power machine according to claim 1, further comprising a first starting tube connected to the heater and to the turbine.

4. The power machine according to claim 1, further comprising an alternator connected to the turbine, wherein the alternator is configured to generate an alternating current from work generated by the turbine.

5. A method for operating the power machine according to claim 1, comprising:

pressurizing the liquid air in the storage tank by the pump and transferring the pressurized liquid air to the first heat exchanger;

heating the pressurized liquid air by the first heat exchanger with the atmospheric air;

transferring the heated pressurized liquid air to the heater;

heating, by the heater, the heated pressurized liquid air to the atmospheric air temperature; and conveying the liquid air heated by the heater to the turbine to generate work by the turbine.

6. The method according to claim 5, wherein the heating the pressurized liquid air by the first heat exchanger comprises pressing the ambient air into the first heat exchanger by the radial compressor to heat the pressurized liquid air by the first heat exchanger.

7. The method according to claim 5, wherein the heating by the heater comprises utilizing a fan in the heater.

8. The method according to claim 7, wherein the blowing speed of the fan is at least 1.5 m/s to prevent freezing.

9. The method according to claim 5, further comprising:

transferring the liquid air from the turbine to the second heat exchanger to cool the liquid air in the second heat exchanger.

10. The method according to claim 9, further comprising:

transferring the liquid air from the second heat exchanger to the first Joule-Thomson valve; and expanding the liquid air in the first Joule-Thomson valve with constant enthalpy.

11. The method according to claim 5, further comprising:

transferring steam from the storage tank to the second heat exchanger to cool the steam from the storage tank.

12. The method according to claim 11, further comprising:

transferring the cooled steam to the first heat exchanger via the radial compressor to reduce a pressure of the cooled steam and to further cool the cooled steam in the first heat exchanger.

13. The method of claim 12, further comprising:

transferring the further cooled steam to the second Joule-Thomson valve such that the further cooled steam is expanded with constant enthalpy.

14. The method of claim 13, further comprising:

transferring the expanded cooled steam to the storage tank.

* * * * *